US005934200A

United States Patent [19]

Lydic

[11] Patent Number: 5,934,200

[45] Date of Patent: Aug. 10, 1999

[54] LIGHTWEIGHT HOPPER CAR

[75] Inventor: Todd L. Lydic, Johnstown, Pa.

[73] Assignee: Johnstown America Corporation, Chicago, Ill.

[21] Appl. No.: 08/843,007

[22] Filed: Apr. 11, 1997

[51] Int. Cl.[6] ..... B61D 7/00

[52] U.S. Cl. ..... 105/248; 105/253; 105/404

[58] Field of Search ..... 105/244, 245, 105/246, 247, 248, 253, 404, 406.1, 407, 409, 410, 411, 250, 251, 252, 249; 298/24, 27, 29, 30

[56] References Cited

U.S. PATENT DOCUMENTS

| | | | |
|---|---|---|---|
| 3,253,556 | 5/1966 | Glaser et al. | 105/247 |
| 3,713,399 | 1/1973 | Bembridge et al. | 105/248 |
| 4,016,691 | 4/1977 | Cale | 105/248 |
| 4,292,898 | 10/1981 | Gordon et al. | 105/248 |
| 4,644,871 | 2/1987 | Arrey et al. | 105/248 |
| 4,884,511 | 12/1989 | Hallam et al. | 105/248 |
| 5,390,607 | 2/1995 | Lydic | 105/247 |

*Primary Examiner*—Mark T. Le
*Attorney, Agent, or Firm*—Webb Ziesenheim Logsdon Orkin & Hanson, P.C.

[57] ABSTRACT

A lightweight hopper-type rail car provides for a smooth exterior surface so as to minimize aerodynamic drag thereon when the car is in motion. The railcar includes a cross ridge arrangement which greatly increases the fabrication efficiency of the car as well as providing a smooth interior surface so as to allow the maximum release of bulk material contained within the car.

20 Claims, 6 Drawing Sheets

LIGHTWEIGHT HOPPER CAR

BACKGROUND OF THE INVENTION

Bottom unloading hopper cars are familiar in the art. These cars serve to transport dry, bulk material and are recognizable as having a configuration adapted to receive bulk material from an overhead source and contain same for transport. Additionally, these cars are equipped with vertically elongated sections displaced periodically along the car which terminate in a plurality of discharge gates which are arranged along the lower side of the hopper. These gates are adapted to allow for a rapid discharge of the contained freight into a receiving container placed below the car. Previous hopper cars have displayed features which are now known to run counter to presently perceived needs. In previous cars, car weight and therefore cost of movement thereof was not a particular concern. In the present day, however, cars must demonstrate efficiencies in transporting goods which heretofore were unheard of. Another aspect of previous cars was a total disregard of aerodynamic efficiencies which, in a similar way to car weight, had a marked effect on fuel requirements and which, in prior days, were at minimal concern to those companies operating the cars.

Regarding hopper cars specifically, prior cars have maintained an interiorly angular aspect which was ill-disposed to provide full delivery of the bulk product contained therein. These prior cars, which disclosed a surfeit of weldments, attracted and retained product in these seams, with small regard for contamination concerns or subsequent loads. Additionally, these lateral seams necessitated additional labor in fabrication of the car and correspondingly increased the cost therefor.

SUMMARY AND OBJECTS OF THE INVENTION

The instant invention is a rapid discharge type car falling into the class of cars commonly known as hopper cars. This car incorporates a variety of useful and novel features which are directed toward increasing the efficiency of transferring freight.

The first among these features related to the construction of the side walls of the car. In the instant car, the vertically disposed side stakes are positioned interior to the car side wall, thereby reducing aerodynamic drag of the instant car over previous designs.

The car further comprehends an improved gate design which is disclosed in U.S. Pat. No. 5,249,531 to Taylor which is incorporated herein by reference. These hopper doors, named herein as gates utilize an improved actuating mechanism which is adapted to provide more efficient off-loading of the car than was available with previous designs. Returning to the design of the hopper body, the vertical side stakes are arranged to be co-terminal with the apices of the lower surface of the hopper body or conversely to be centrally disposed between the off loading gates of the car. This design allows for a minimal capture of contaminants with the hopper body and more complete off loading therefrom. An additional feature is in the design of the cross ridges which are disposed below the apices of the hopper body bottom member and are operative to provide support thereto. These cross ridges display a laterally extended vertical web which is designed to allow the bottom surface of the hopper body to be formed thereover and attached thereto so as to provide for reduced fastening and a smooth transition of the hopper body bottom plate over the several apices associated with the hopper bottom.

This ability to co-form a smooth transition of the car's lower surface serves to further reduce retention of freight material within the hopper body by directing a smooth flow of material out of the off-load gates as well as greatly streamlining the assembly process thereof.

The instant car further includes a plurality of side bolsters which display a triangular cross-sectional aspect. This design provides for greater linear rigidity for the car and correspondingly greater weight carrying capacity while allowing for torsional deflection of the car body to proceed unimpeded.

Therefore it is a primary object of the invention to provide for a railcar having inwardly disposed side stakes so as to provide for improved laminar flow of air thereover. It is another object of the invention to provide for cross ridges having a vertical web so as to allow conformation of the bottom sheet of the car body thereover. It is a further object of the invention to provide for a bottom discharge railcar having a minimized retention of bulk material contained therein.

It is an additional object of the invention to provide a lightweight bottom discharge railcar. It is another object of the invention to provide a rapid discharge railcar displaying an improved dry weight to loaded weight ratio.

It is a further object of the invention to provide a bottom discharge hopper car having greater freight holding capacity.

It is an additional object of the invention to provide for a railcar having a reduced number of fasteners associated with the construction thereof.

These and other objects of the instant invention will become apparent from the detailed description of the preferred embodiment, drawings and claims appended hereto.

DETAILED DESCRIPTION OF THE PREFERRED EMBODIMENT

Figure 1:
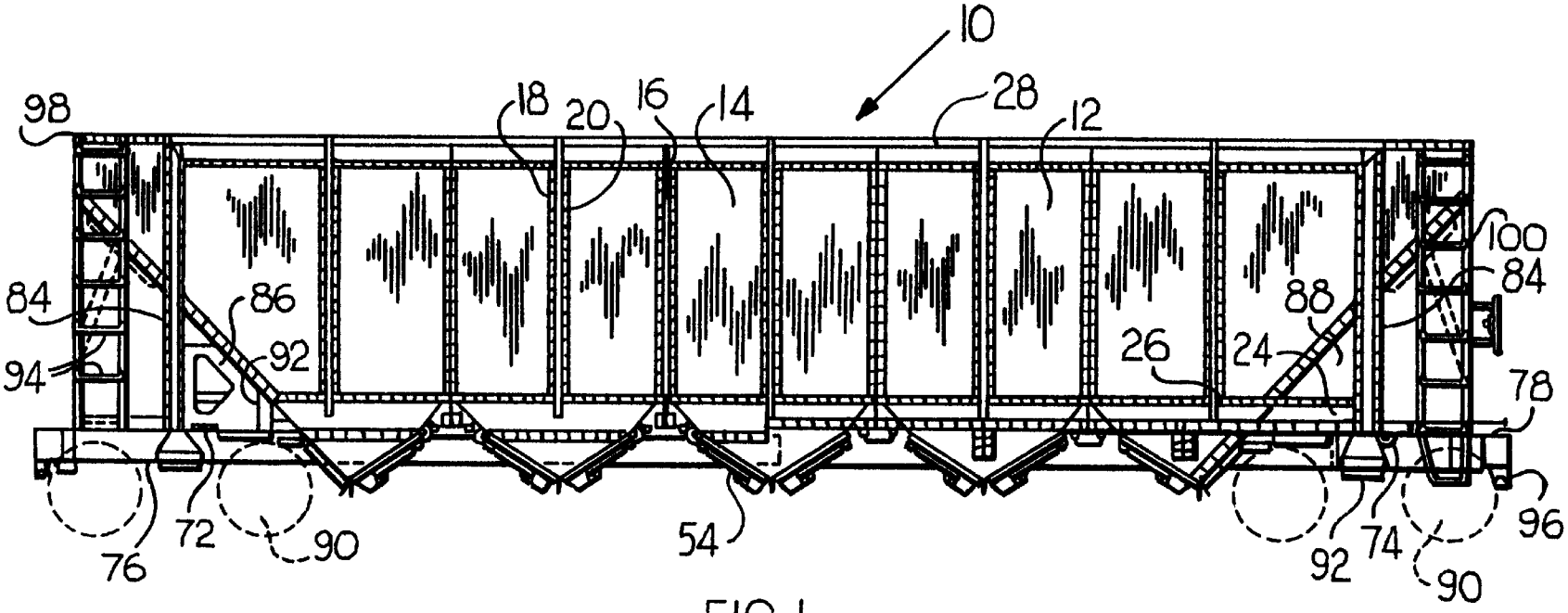
FIG. 1 is a side view of the instant invention.
Figure 2:
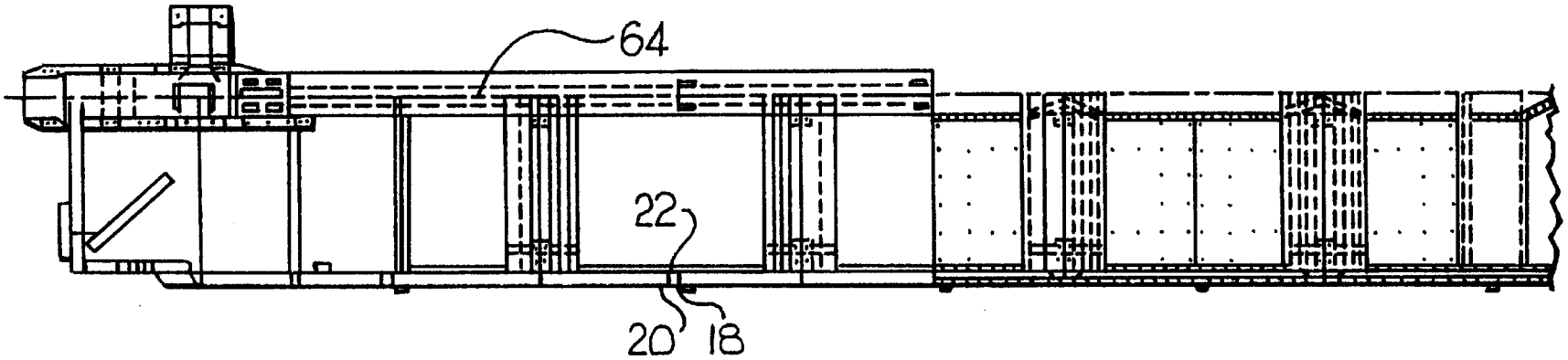
FIG. 2 is a top half view of the novel rail car.

The fast discharge hopper car 10 includes a body 12 which is formed by a plurality of side sheets 14, which are, in the preferred embodiment, aluminum alloy. The side walls or sheets 14 are assembled into the body 12 by attaching same to a plurality of interiorly disposed side stakes 16 wherein these side stakes 16 display two coplanar web extensions 18, 20 and a transverse web 22 which is disposed toward the interior of the car body 12. These side stakes 16 are further attached endwise to the car's side sills 24 at the lower end 26 of the side stakes 16 and are also attached to the car's top chord 28 at the upper end 30 of the side stakes 16. The car 10 displays two such structures corresponding to the left and right sides of the car respectively. The side sills 24 are composed of an aluminum extrusion having a right-triangular cross-sectional aspect. The side sill extrusion displays an upper web 32 and a lower web (not shown) which extend from main triangular tube 36 of the side sill 24.

This shape allows for connection of various associated assemblies to the side sill 24 while allowing the side sill 24 to be formed in a light weight, yet rigid manner.

Extending between the left side wall and the right side wall of the car 10 and connecting same into a unitary structure are a plurality of cross ridges 38. Each cross ridge 38 includes a vertically extending web 40. This web 40 further includes an extended teardrop shaped member 42. This member 42 displays a rounded distal end 44, substantially planar side 46, a second substantially planar side 48 and an angular proximal end 50. The angular proximal end 50 is integral with the vertically disposed cross ridge web 40. This teardrop aspect of the cross ridge member 42 allows for a conformation of the floor sheets 52 of the car 10 with the cross ridges 38. This allows for an improved efficiency in construction of the car 10 as well as providing a smoother interior surface thereof. Additionally, the cross ridges 38 further incorporates a transverse cross ridge web 39 which is operative to provide for an attachment point for associated assemblies such as the gate hinges which shall be subsequently described.

Figure 8:
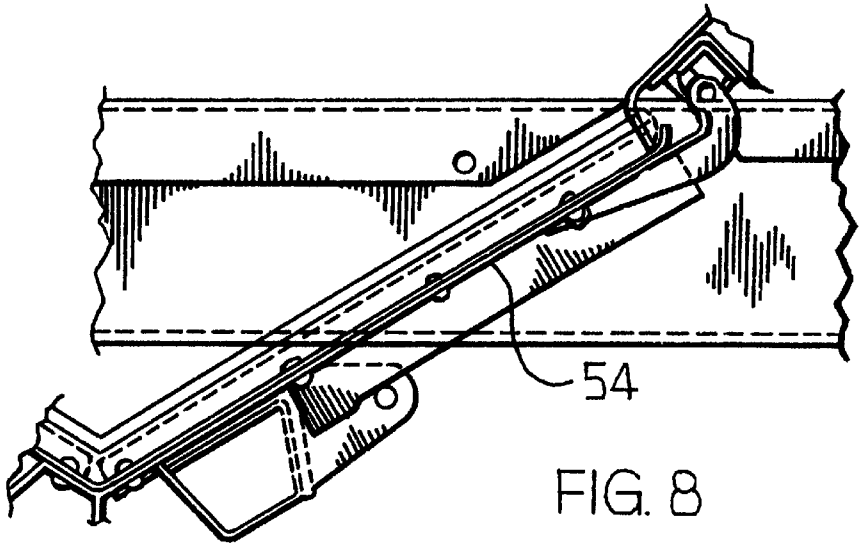
FIG. 8 is a side view of the gate assembly.
Figure 6:
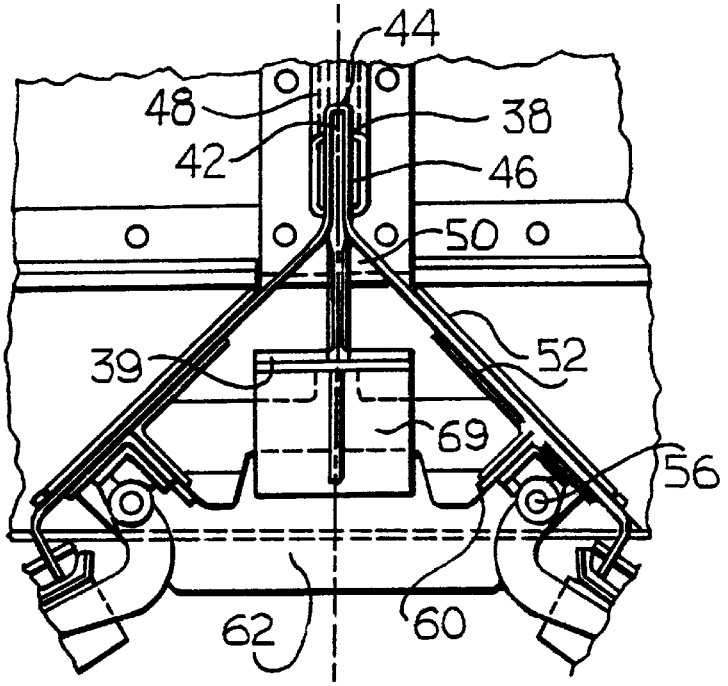
FIG. 6 is an end view of the cross ridge.
Figure 7:
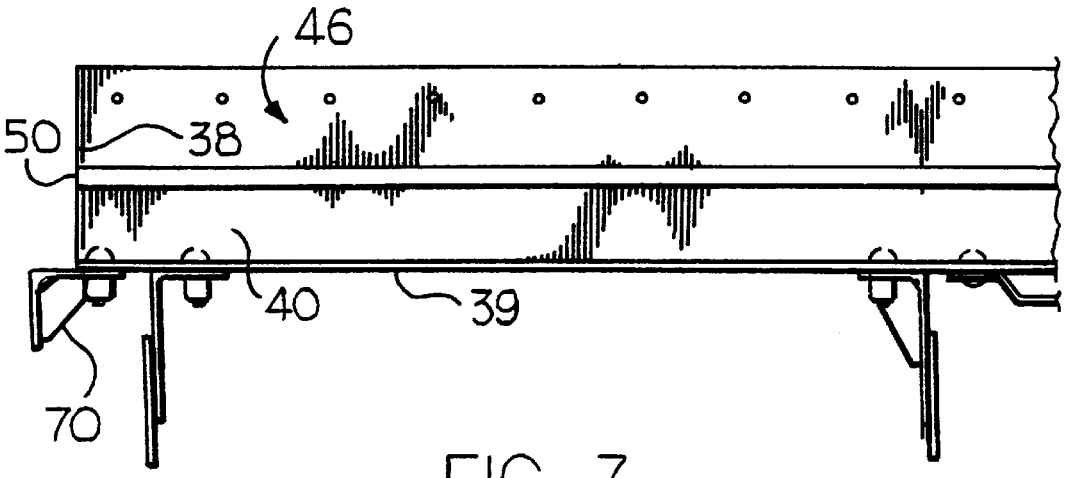
FIG. 7 is a side view of the cross ridge with the floor removed for clarity.

As aforesaid, the floor sheets 52 are conformed over the teardrop member 42 of the cross ridges 38 and attached thereto. The floor sheets 52 extend angularly downwardly from the cross ridges 38 and terminate at the discharge gates 54 which act as extensions of the floor sheets 52 and serve to selectively close off the bottom of car 10. The gates are shown in FIG. 8 and disclosed in U.S. Pat. No. 5,249,531 and therefore will not be elaborated on here. As seen in FIG. 6, the gate hinges 56 are attached to the floor sheets 52 by hinge brackets 60 which are further attached to a hinge support plate 62 which in turn, depends from a crossbar 68. This crossbar 68, is affixed to the associated cross ridge 38 and as shown in FIG. 7 the cross ridge is attached to the side sill 24 by reinforced brackets 70. Additionally, the side stakes 16 which are disposed above cross ridges 38 are attached to the cross ridges 38 and thereby transfer their load to the associated side sill 24.

Figure 3:
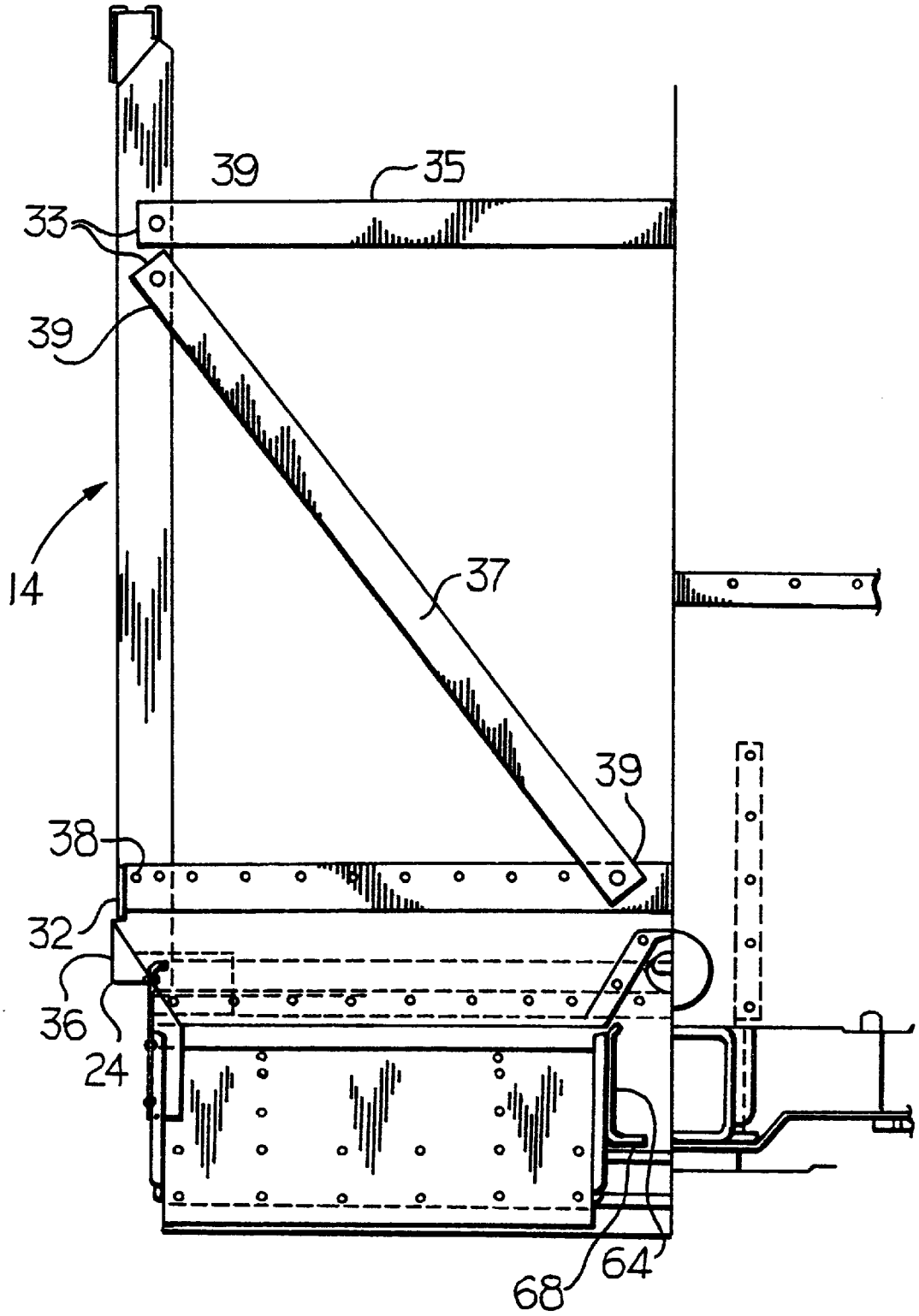
FIG. 3 is an end view of a section of the car at one of the cross ridge assemblies.
Figure 4:
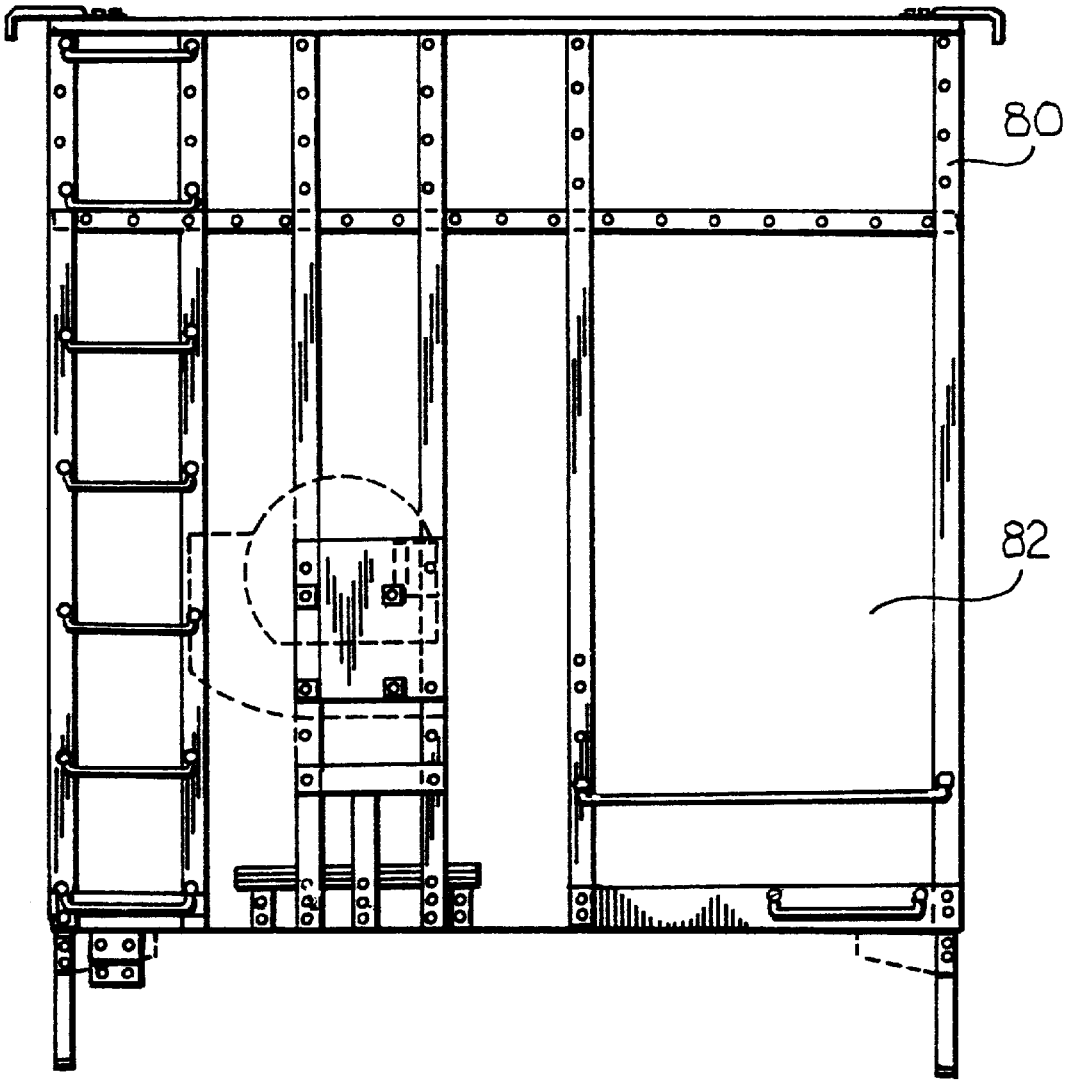
FIG. 4 is an end view of the car.

As shown in FIG. 3, the cross ridges 38 also serve as attachment points for K-frame supports 33. These supports 33 are rectangular aluminum extrusions which serve to stabilize the sidewalls 14. Both the transverse K-frame support 35 and the diagonal K-frame support 37 have c-shaped slots in the ends thereof to provide tongue-in-groove mating between the individual K-frame support 33 and either the associated cross ridge 38 or sidestake 16. The K-frame supports 33 are affixed to the associated members by pins so as to allow for deflectable attachment therebetween.

A center sill 64 is disposed along the longitudinal centerline of the car 10. The center sill 64 is of a unitary rectangular cross-section and includes a first wing 68 and a second wing (not shown) which are disposed longitudinally along the center sill 64 and serve as attachment points for both cross ridges 38 and associated floor sheets 52 as well as the tie plates 72, 74 which connect the center sill 64 to the draft sills 76, 78 by appropriate fasteners or welding.

Figure 5:
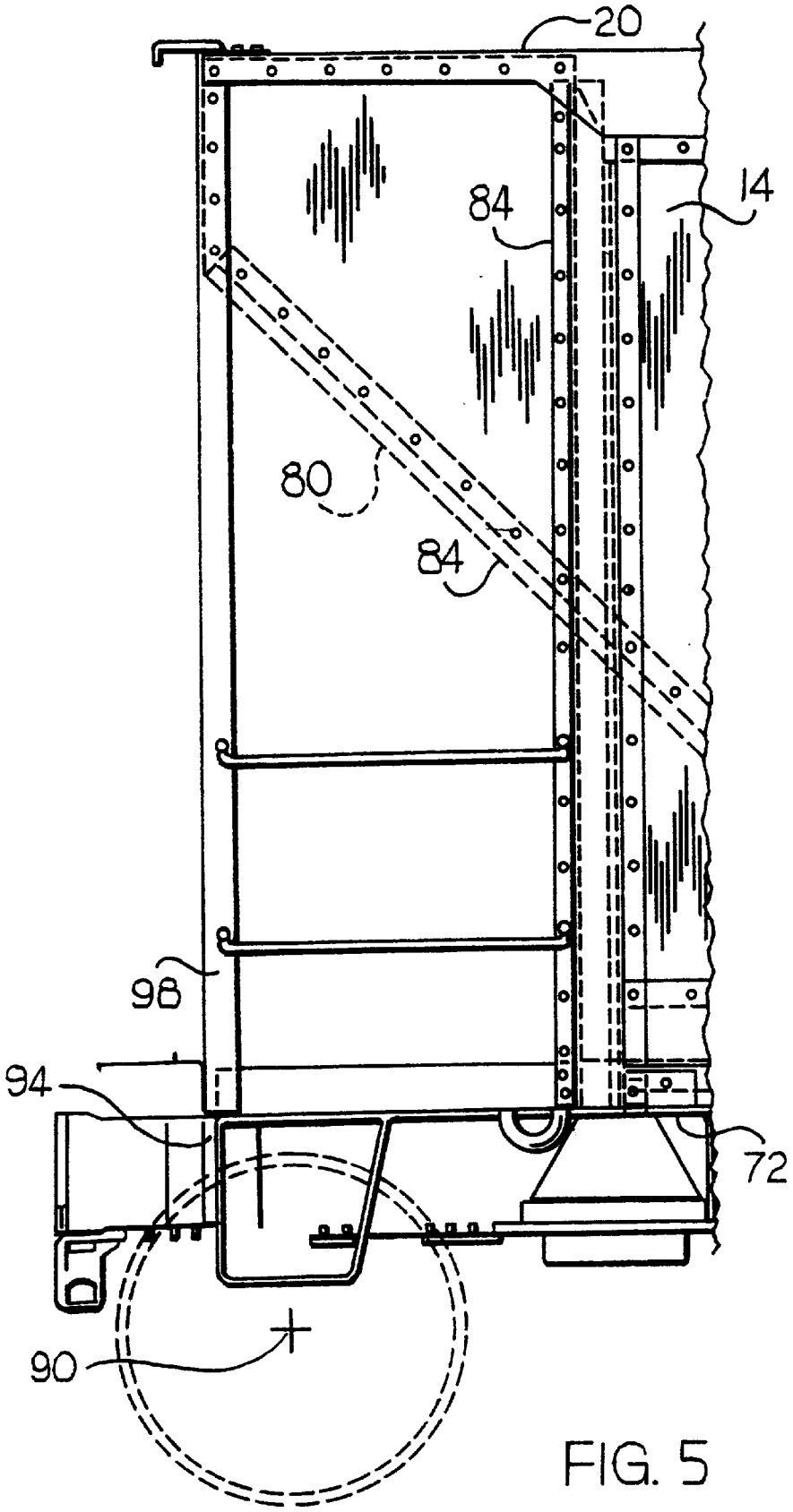
FIG. 5 is a view of the car end as seen transversely to the car.

Referring now to FIG. 5, the ends of the car 10 includes diagonal stakes 80 which are rectangular tubular aluminum extrusions which provide a transition from the substantially vertical sidewalls 14 to the diagonally placed endwalls 82 of the car 10. The diagonal stakes 80 together with the bolsters 84 and the top chord 28 provide for support of endwalls 82 is provided by webs 86, 88 which are disposed below the outer edges of the endwalls 82 and thereby further serve to transfer the load of the endwalls 82 to the side sills 24. The diagonal stakes 80 are attached to each other by a plurality of fasteners.

Bolsters 84 are further affixed to the ends of the side sills 24 and also serve to transfer their loading thereto.

Disposed below the draft sills are AAR standard trucks 90.

To adapt the car 10 to rotary unloading, the side sills 24 are equipped with wear plates 92 disposed therebelow which serve to preserve the side sills 24 from damage during a rotary dump procedure.

Disposed outwardly from the draft sills 76, 78 are a plurality of end plates 94, 96 which extend out to the maximum transverse extension of the car. Disposed upwardly from the outer ends of the end plates 94, 96 are a plurality of access ladders 98, 100 which extend from the end plate to the top chord 28 of the car 10.

I claim:

1. A hopper railcar comprising:

a body, said body including a first sidewall and a second sidewall;

a plurality of inwardly disposed side stakes attached to said sidewalls, wherein said first and second sidewalls have inwardly disposed side stakes associated therewith; and a plurality of transversely disposed cross ridges located below said side walls, wherein each said cross ridge includes a substantially horizontal cross ridge web and an elongate, substantially vertical member extending upwardly from said cross ridge web, wherein said vertical member includes a teardrop-shaped top portion.

2. The railcar according to claim 1, wherein each said teardrop-shaped top portion of said vertical member includes a cross-sectionally semicircular portion connected with substantially planar sides.

3. The railcar according to claim 2 and said railcar further comprising a floor having a plurality of floor sheets wherein said floor sheets are conformed over said semicircular portion.

4. The railcar according to claim 3 and said floor sheets being further conformed over said substantially planar sides and attached thereto.

5. The railcar according to claim 1 further comprising bolsters operative to support a plurality of end walls.

6. The railcar according to claim 5 and said bolsters having a substantially rectangular cross section.

7. The railcar according to claim 6 and a plurality of diagonal stakes having ends, wherein at least one of said ends is attached to said bolster and said diagonal stakes have a substantially rectangular cross section.

8. The railcar according to claim 1, further including a plurality of top chords and a plurality of side sills, wherein said side stakes extend between said top chord and said side sills and wherein said cross ridges connect said side stakes to said side sills.

9. The railcar according to claim 1, further including a plurality of K-frames formed by K-frame supports, wherein each said K-frame includes supports attached to at least one of said side stakes and one of said cross ridges.

10. The railcar according to claim 9 wherein each said K-frame includes a slot at an end thereof.

11. The railcar according to claim 1, wherein said vertical member of each said cross ridge is integral with said horizontal web of said cross ridge.

12. A hopper railcar comprising:

a plurality of top chords;

a plurality of side sills;

a plurality of side stakes extending from said top chords to said side sills; and a plurality of cross ridges disposed transversely between said side sills, wherein each said cross ridge includes a substantially horizontal cross ridge web and a substantially vertical member extending upwardly from said cross ridge web, said vertical member including a teardrop-shaped top portion and wherein each said cross ridge provides a connection between one said side stake and one said side sill.

13. The railcar according to claim 12 and said car further comprising a floor, wherein said floor is conformed to said vertical member and affixed thereto.

14. The railcar according to claim 13 and said vertical member shaped to allow for a smooth conformation of said floor thereto.

15. The railcar according to claim 12 and said rail car further comprising a plurality of end walls and a first sidewall and a second sidewall wherein said end walls and said first sidewall and said second side wall are aluminum.

16. The railcar according to claim 15 and a diagonal stake and a bolster wherein said bolster is disposed conterminous to one of said end walls and said side wall and said bolster being a substantially rectangular aluminum extrusion.

17. The railcar according to claim 12 further including a center sill disposed inwardly from each said side sill wherein said center sill is a unitary extrusion.

18. The railcar according to claim 17 further including a floor disposed interiorly to said side stakes, said floor being adapted to provide a smooth interior surface.

19. The railcar according to claim 15, wherein said plurality of side stakes are positioned inwardly of said sidewalls to provide an aerodynamically efficient hopper railcar.

20. A hopper railcar comprising:

a plurality of side stakes;

a plurality of transversely disposed cross ridges, wherein each said cross ridge includes a substantially horizontal cross ridge web and a substantially vertical member extending upwardly from said cross ridge web, said vertical member including a teardrop-shaped top portion; and a plurality of K-frames formed by K-frame supports, wherein each said K-frame includes supports attached to at least one of said side stakes and one of said cross ridges, wherein each said K-frame support includes a slot at an end thereof.

* * * * *

UNITED STATES PATENT AND TRADEMARK OFFICE

CERTIFICATE OF CORRECTION

PATENT NO. : 5,934,200

DATED : August 10, 1999

INVENTOR(S) : Todd L. Lydic

It is certified that error appears in the above-identified patent and that said Letters Patent is hereby corrected as shown below:

Column 1 Line 47 delete "comprehends" and insert --includes--.

Column 3 Line 61 "includes" should read --include--.

Column 6 Line 4, claim 18, "according to claim 17" should read --according to claim 12--.

Signed and Sealed this

Twenty-ninth Day of February, 2000

*Attest:*

Q. TODD DICKINSON

*Attesting Officer*

*Commissioner of Patents and Trademarks*